US011808498B2

(12) United States Patent
Coyle et al.

(10) Patent No.: US 11,808,498 B2
(45) Date of Patent: Nov. 7, 2023

(54) BULBLESS THERMAL EXPANSION VALVE

(71) Applicant: Parker-Hannifin Corporation, Cleveland, OH (US)

(72) Inventors: Eric R. Coyle, Washington, MO (US); Raghujit Prasad Kunapuli, Chesterfield, MO (US); Richard C. Larash, Ellisville, MO (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 18/299,883

(22) Filed: Apr. 13, 2023

(65) Prior Publication Data

US 2023/0251006 A1 Aug. 10, 2023

Related U.S. Application Data

(63) Continuation of application No. PCT/US2022/027417, filed on May 3, 2022.
(Continued)

(51) Int. Cl.
*F25B 41/335* (2021.01)

(52) U.S. Cl.
CPC ..... *F25B 41/335* (2021.01); *F25B 2500/15* (2013.01)

(58) Field of Classification Search
CPC ..... F25B 41/335; F25B 2500/15; F25B 2400/0411
See application file for complete search history.

(56) References Cited

U.S. PATENT DOCUMENTS 4,819,443 A * 4/1989 Watanabe ..... F25B 41/335 236/92 B
4,979,372 A * 12/1990 Tanaka ..... F25B 41/335 236/92 B
(Continued)

FOREIGN PATENT DOCUMENTS

CN 101255931 A 9/2008
CN 101749901 A * 6/2010 ..... F25B 41/062
(Continued)

OTHER PUBLICATIONS

International Search Report and Written Opinion of the International Searching Authority for corresponding International Patent Application No. PCT/US2022/027417, dated Aug. 5, 2022.
(Continued)

*Primary Examiner* — Kun Kai Ma
(74) *Attorney, Agent, or Firm* — Renner, Otto, Boisselle & Sklar, LLP

(57) ABSTRACT

A bulbless expansion valve including a valve body, a valve member, a power element, and a thermal sensor including an enclosure operatively mounted to the valve body. The power element includes a diaphragm having a first side operatively coupled to the valve member, and a second side that together with the sensor enclosure forms at least part of a sensing chamber containing sensing fluid such that the sensing fluid is in communication with the second side of the diaphragm. The first side of the diaphragm may be fluidly coupled to an operating line, such as a suction line, to communicate temperature and pressure to the first side of the diaphragm, thereby providing heat transfer with the sensing fluid on the opposite side. Temperature changes of the sensing fluid results in pressure changes applied to the diaphragm causing movement of the valve member to control flow of the operating fluid.

20 Claims, 9 Drawing Sheets

Related U.S. Application Data

(60) Provisional application No. 63/184,242, filed on May 5, 2021.

(56) References Cited

U.S. PATENT DOCUMENTS

| | | | | |
|---|---|---|---|---|
| 4,982,578 | A | 1/1991 | Heffner et al. | |
| 6,612,503 | B2 | 9/2003 | Hirota et al. | |
| 7,513,684 | B2 | 4/2009 | Tart | |
| 2004/0112974 | A1* | 6/2004 | Law | F16L 41/082 236/92 B |
| 2015/0052924 | A1* | 2/2015 | Milliman | F25B 43/003 137/550 |

FOREIGN PATENT DOCUMENTS

| | | | | |
|---|---|---|---|---|
| EP | 0829690 | A1 | 3/1998 | |
| EP | 1179715 | A2 * | 2/2002 | F25B 41/062 |
| EP | 1179716 | A2 * | 2/2002 | F25B 41/062 |
| JP | S6277575 | A | 4/1987 | |
| JP | 2005037016 | A * | 2/2005 | |
| WO | 2016075897 | A1 | 5/2016 | |

OTHER PUBLICATIONS

"Sporlan Thermostatic Expansion Valves—Theory of Operation, Application, and Selection," Parker Hannifin Corporation, Bulletin 10-9, Mar. 2011, retrieved from the Internet on Jan. 9, 2023: https://www.parker.com/content/dam/Parker-com/Literature/Sporlan/Sporlan-pdf-files/Sporlan-pdf-010/10-9.pdf.

* cited by examiner

BULBLESS THERMAL EXPANSION VALVE

RELATED APPLICATIONS

This application is a continuation of International Application No. PCT/US2022/027417 filed May 3, 2022, which claims the benefit of U.S. Provisional Application No. 63/184,242 filed May 5, 2021, each of which is hereby incorporated herein by reference in its entirety.

TECHNICAL FIELD

The present invention relates to expansion valve technology, and more particularly to thermal or thermostatic expansion valves (TEVs).

BACKGROUND

A TEV is a component of a vapor compression system (for example, a residential air conditioner system) that is used for refrigerant expansion and cooling. The flow control of refrigerant by a TEV conventionally is achieved by sensing the temperature of the suction line via a bulb that is mechanically coupled to the suction line. The actuator portion of the TEV (away from the pin and port) is referred to as the power element which is fluidly connected to the sensing bulb using a metallic capillary tube. The sensing bulb is charged with refrigerant, which expands or contracts with changes in temperature (and pressure). Change in temperature (and pressure) is communicated to the power element via the capillary tube. The changes in pressure cause a welded diaphragm to move within the element, which in turn exerts force on the pin to move closer or away from a port, thus opening or closing the valve. The control achieved using Pressure-Temperature (P-T) relationship is referred to as superheat control and this is an adjustable feature within a TEV by means of a spring and an adjustable mechanism provided at the lower section of the valve.

SUMMARY

An aspect of the present disclosure provides a thermal expansion valve (TEV) that integrates the thermal sensing element with the main part of the valve, such as by operatively coupling, or integrating, a thermal sensor with the power element of the valve.

Accordingly, at least one aspect of the present disclosure provides a TEV that does not utilize an external thermal sensing bulb with a corresponding external capillary tube to sense temperature in the system, such as the temperature of the refrigerant suction line.

According to an aspect, a bulbless thermal expansion valve includes a valve body having an inlet and an outlet; a valve member movable relative to the valve body for controlling flow of operating fluid through the valve body; a power element including a diaphragm having a first side operatively coupled to the valve member and a second side opposite the first side; a thermal sensor including a sensor enclosure, wherein at least a portion of the sensor enclosure together with at least a portion of the second side of the diaphragm forms at least part of a sensing chamber in which a sensing fluid is contained, wherein changes in the temperature of the sensing fluid results in changes in pressure applied to the second side of the diaphragm, thereby causing movement of the diaphragm which provides movement of the valve member operatively coupled to the first side of the diaphragm.

As mentioned above, the expansion valve is devoid of a sensing bulb and external capillary tube, and thus all of the sensing fluid may be contained in a closed thermodynamic system in the sensor enclosure.

In some embodiments, the sensor enclosure, such as a dome or other suitable structure or housing, is configured to be closely coupled to a thermal member of a refrigerant-based system, such as an operating line (e.g., suction line) of the system, so that changes in temperature of the thermal member are communicated to, and result in, changes in temperature of the sensing fluid.

In other embodiments, the sensor enclosure is spaced apart from the operating line (e.g., suction line) of the system. For example, the sensor enclosure containing the sensing fluid may be arranged so that it does not intersect with a flow path of operating fluid flowing through the valve body. Such a configuration can reduce the reactivity of the expansion valve, which may be useful to prevent overshooting or hunting phenomena.

In exemplary embodiments, a thermal damper is arranged between the sensor enclosure and the thermal member of the refrigerant system, such as the suction line or other operating line. Such a thermal damper can reduce heat transfer from the valve body to the sensor enclosure, which can reduce reactivity of the expansion valve and improve the operational control provided by the power element. For example, the operating line may be formed by part of the valve body, and the thermal damper may be formed as an insulative spacer or coating that is arranged between the sensor enclosure and the valve body. In exemplary embodiments, the power element may include a casing that is mounted to the valve body at a location between the sensor enclosure and the valve body, and the thermal damper may be arranged between the casing of the power element and the valve body. The thermal damper may be made from any suitable material in any suitable form that reduces heat transfer between the two members. For example, a thermal damper in the form of a thermal insulator may be made from a suitable polymer, for example nylon, or other suitable material having low thermal conductivity. Alternatively or additionally, the thermal damper may be a structure with an increased thickness to reduce heat conduction.

Accordingly, an aspect of the present disclosure provides a bulbless thermal expansion valve for a system, the expansion valve including: a valve body having a first fluid passage extending between a first inlet and a first outlet of the valve body, and a second fluid passage extending between a second inlet and a second outlet of the valve body; a valve member movable along a longitudinal axis relative to the valve body for controlling expansion of coolant flowing through the first fluid passage of the valve body; a power element including a casing and a diaphragm coupled to the casing, the casing including a lower casing portion underlying the diaphragm and an upper casing portion overlying the diaphragm, the diaphragm having a first side operatively coupled to the valve member and a second side opposite the first side, wherein the second side of the diaphragm and the upper casing portion together form at least part of a sensing chamber that constitutes a thermal sensor of the expansion valve; and a thermally insulative spacer arrangement positioned between the lower casing portion and the valve body at a position that is radially outward of the longitudinal axis; wherein the thermally insulative spacer arrangement has a radially inner portion, and the thermally insulative spacer arrangement is configured to prevent direct contact of the lower casing portion with the valve body at all respective points of the lower casing portion and the valve body that are located radially outwardly relative to the radially inner portion; wherein the expansion valve is devoid of a remote sensing bulb; and wherein the sensing chamber contains a thermal sensing fluid in fluid communication with the second side of the diaphragm, such that changes in the temperature of the sensing fluid results in changes in pressure applied to the second side of the diaphragm, thereby causing movement of the diaphragm which provides movement of the valve member operatively coupled to the first side of the diaphragm.

According to another aspect, a bulbless thermal expansion valve for a system includes: a valve body having a first fluid passage extending between a first inlet and a first outlet of the valve body, and a second fluid passage extending between a second inlet and a second outlet of the valve body; a valve member movable relative to the valve body for controlling expansion of coolant flowing through the first fluid passage of the valve body; a power element including a casing and a diaphragm coupled to the casing, the casing including a lower casing portion underlying the diaphragm and an upper casing portion overlying the diaphragm, the diaphragm having a first side operatively coupled to the valve member and a second side opposite the first side, wherein the second side of the diaphragm and the upper casing portion together form at least part of a sensing chamber that constitutes a thermal sensor of the expansion valve; wherein the lower casing portion is mounted to the valve body, and at least a portion of the lower casing portion together with at least a portion of the first side of the diaphragm form at least a portion of a fluid chamber that is fluidly connected to the second fluid passage of the valve body; wherein a seal sealingly engages against the lower casing portion to fluidly seal the fluid chamber; wherein a thermally insulative spacer or a thermally insulative coating is discrete with respect to the seal, and is arranged between the lower casing portion and an upper surface of the valve body to reduce heat transfer between the valve body and the casing; wherein the expansion valve is devoid of a remote sensing bulb; and wherein the sensing chamber contains a thermal sensing fluid in fluid communication with the second side of the diaphragm, such that changes in the temperature of the sensing fluid results in changes in pressure applied to the second side of the diaphragm, thereby causing movement of the diaphragm which provides movement of the valve member operatively coupled to the first side of the diaphragm.

In exemplary embodiments, a fluid flow passage is provided to fluidly connect the operating line, such as the suction line, to a fluid chamber on the first side of the diaphragm of the power element. This communicates the pressure and temperature of the operating fluid flowing through the operating line to the first side of the diaphragm. The heat energy of the operating fluid in the chamber on the first side of the diaphragm interacts with the sensing fluid contained in the sensing chamber on the second side of the diaphragm, whereby changes in the temperature of the sensing fluid results in changes in pressure applied to the diaphragm thereby causing movement of the valve member.

In exemplary embodiments, the casing of the power element holds part of the diaphragm, such as its outer portion, to restriction motion of the diaphragm and improve control.

The sensor enclosure may or may not contain thermal ballast within the sensing chamber. In exemplary embodiments, however, the sensing chamber contains a thermal ballast that slows how fast the temperature and the related pressure in the sensing chamber changes. This feature slows down the reactivity of the TEV and stabilizes the output of the valve during operation.

According to an aspect, a bulbless thermal expansion valve for a system includes: a valve body having a first fluid passage extending between a first inlet and a first outlet of the valve body, and a second fluid passage extending between a second inlet and a second outlet of the valve body; a valve member movable relative to the valve body for controlling expansion of coolant flowing through the first fluid passage of the valve body; a power element including a casing and a diaphragm coupled to the casing, the casing including a lower casing portion underlying the diaphragm and an upper casing portion overlying the diaphragm, the diaphragm having a first side operatively coupled to the valve member and a second side opposite the first side, wherein the second side of the diaphragm and the upper casing portion together form at least part of a sensing chamber that constitutes a thermal sensor of the expansion valve; and a ballast mounted in the sensing enclosure in spaced apart relation relative to the second side of the diaphragm; wherein the expansion valve is devoid of a remote sensing bulb; and wherein the sensing chamber contains a thermal sensing fluid in fluid communication with the second side of the diaphragm, such that changes in the temperature of the sensing fluid results in changes in pressure applied to the second side of the diaphragm, thereby causing movement of the diaphragm which provides movement of the valve member operatively coupled to the first side of the diaphragm.

According to another aspect, a thermal expansion valve for a system includes: a valve body having at least one inlet, at least one outlet, and one or more fluid flow paths; a valve member movable relative to the valve body for controlling flow of operating fluid through at least one of the one or more flow paths; a power element including a casing and a diaphragm operatively coupled to the casing, the diaphragm of the power element being operatively coupled to the valve member for effecting movement of the valve member and thereby controlling flow of the operating fluid through the valve body; and a thermal sensor including an enclosure forming at least a portion of a sensing chamber that contains a sensing fluid; wherein at least a portion of a first part of the casing together with at least a portion of a first side of the diaphragm form at least a portion of a first fluid chamber, the first fluid chamber being fluidly connected to an operating line of the system to fluidly communicate with operating fluid passing through the operating line; wherein at least a portion of a second part of the casing together with at least a portion of a second side of the diaphragm form at least a portion of a second fluid chamber, the second fluid chamber being fluidly connected to the sensing chamber of the thermal sensor to fluidly communicate with the sensing fluid; wherein the casing of the power element is arranged between the enclosure of the thermal sensor and the valve body, the enclosure of the thermal sensor being operatively mounted to the second part of the casing, and the first part of the casing being operatively mounted to the valve body; and wherein the expansion valve is configured such that heat energy is transferable across the diaphragm between the operating fluid communicating with the first chamber on the first side of the diaphragm and the sensing fluid communicating with the second chamber on the second side of the diaphragm, and such that changes in temperature of the sensing fluid results in changes in pressure at the second side of the diaphragm which generates a force on the diaphragm that causes movement of the valve member in response to the changes in force on the diaphragm resulting from the changes in temperature of the sensing fluid.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

Embodiments according to the present disclosure will now be described in further detail with reference to the accompanying drawings, in which.

DETAILED DESCRIPTION

Figure 1:
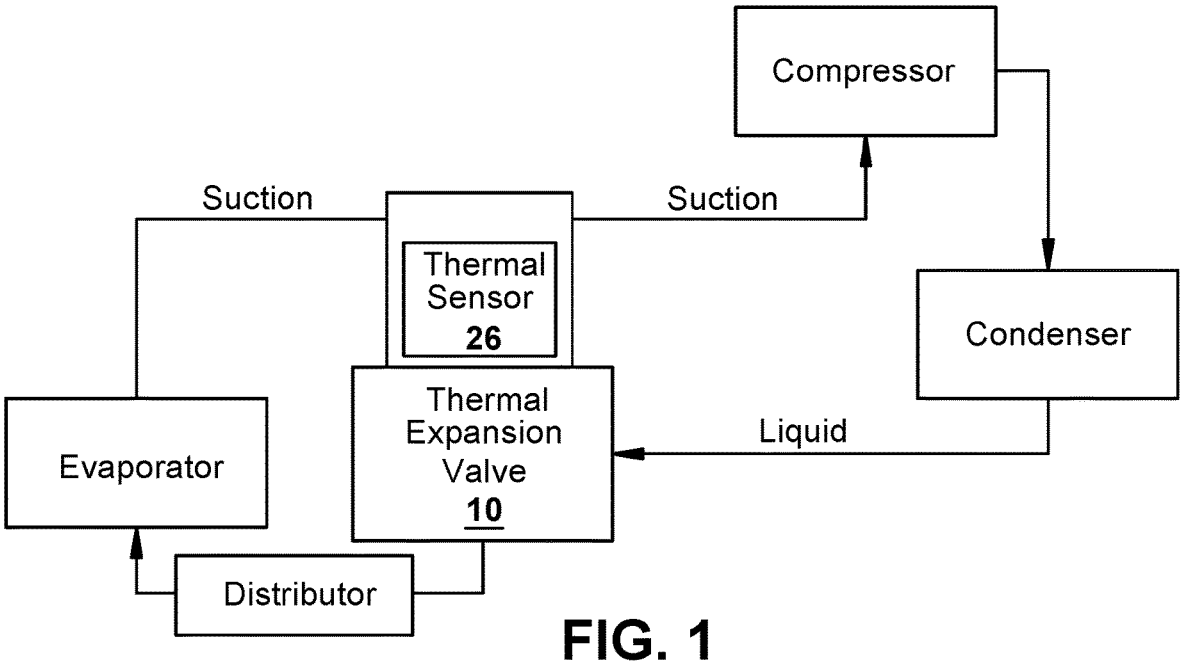
FIG. 1 is an exemplary schematic diagram of a system incorporating a bulbless TEV according to an embodiment of the present disclosure.

Referring to FIGS. 1-12, exemplary embodiments of a thermal expansion valve (TEV) 10 are shown, in which the same or similar parts will be referred to with the same reference numerals. It is understood that one or more features or aspects of these various embodiments may be substituted for one another or used in conjunction with one another where applicable, as would be understood by those having ordinary skill in the art.

According to an aspect, the exemplary TEVs 10 shown and described herein are bulbless TEVs, in which the TEV does not utilize an external thermal sensing bulb with a corresponding external capillary tube to sense temperature in the suction line. Rather, according to at least one aspect, the exemplary TEVs integrate the thermal sensing element with the main part of the valve, such as by providing a fluid-containing sensing chamber that is operatively coupled to, or integrated with, the power element of the valve.

Generally, the exemplary TEVs 10 described herein include a valve body 12 having an inlet 14 and an outlet 16, and a valve member 18 coupled to a power element 20 for controlling movement of the valve member 18 to thereby control flow of operating fluid through the valve body 12. The TEV 10 also includes a thermal sensor 26 operatively mounted to the power element 20 and/or valve body 12. The thermal sensor 26 includes a sensor enclosure 28 (or housing 28) that at least partially forms a sensing chamber 30 that contains a sensing fluid. The TEV 10 is configured such that changes in temperature of the sensing fluid in the sensing chamber 30 results in changes in pressure applied to the power element 20, thereby causing movement of the valve member 18 to control flow of the operating fluid.

Turning to FIG. 1, a schematic diagram of an exemplary system incorporating the TEV 10 is shown. The system is shown as a refrigerant system, including an evaporator contained within a space that is to be cooled, a condenser that is located outside of the cooled space, a compressor positioned between the evaporator outlet and the condenser inlet, and the TEV 10 located downstream of the condenser and upstream of the evaporator. A refrigerant circulating through the system is compressed by the compressor which raises the temperature and pressure of the refrigerant. The then hot pressurized refrigerant gas flows through the condenser which serves as heat exchanger to allow the refrigerant to dissipate heat. The condenser lowers the refrigerant temperature such that the refrigerant condenses into a liquid. The liquid refrigerant then flows through the TEV 10 which serves as a refrigerant modulating valve configured to control flow of the compressed and liquified refrigerant from the condenser to the evaporator. The TEV 10 is configured such that the liquid refrigerant enters the inlet 14 of the valve body 12 and moves from a high pressure zone into a low pressure zone, thus expanding and evaporating some of the refrigerant, and thereby becoming cold. The cold liquid-vapor refrigerant passes through the outlet 16 downstream of the TEV 10 into circuits of the evaporator, thus absorbing heat from inside the space that is to be cooled. The evaporator could be located, for example, in the plenum of a forced air residential or commercial air conditioning system through which air is blown for cooling the interior of the residence or building. The cold liquid-vapor mixture absorbs heat from the evaporator thereby returning the refrigerant to a gaseous vapor state. The refrigerant vapor is then returned to the compressor through a suction line and the cycle repeats.

Figure 12:
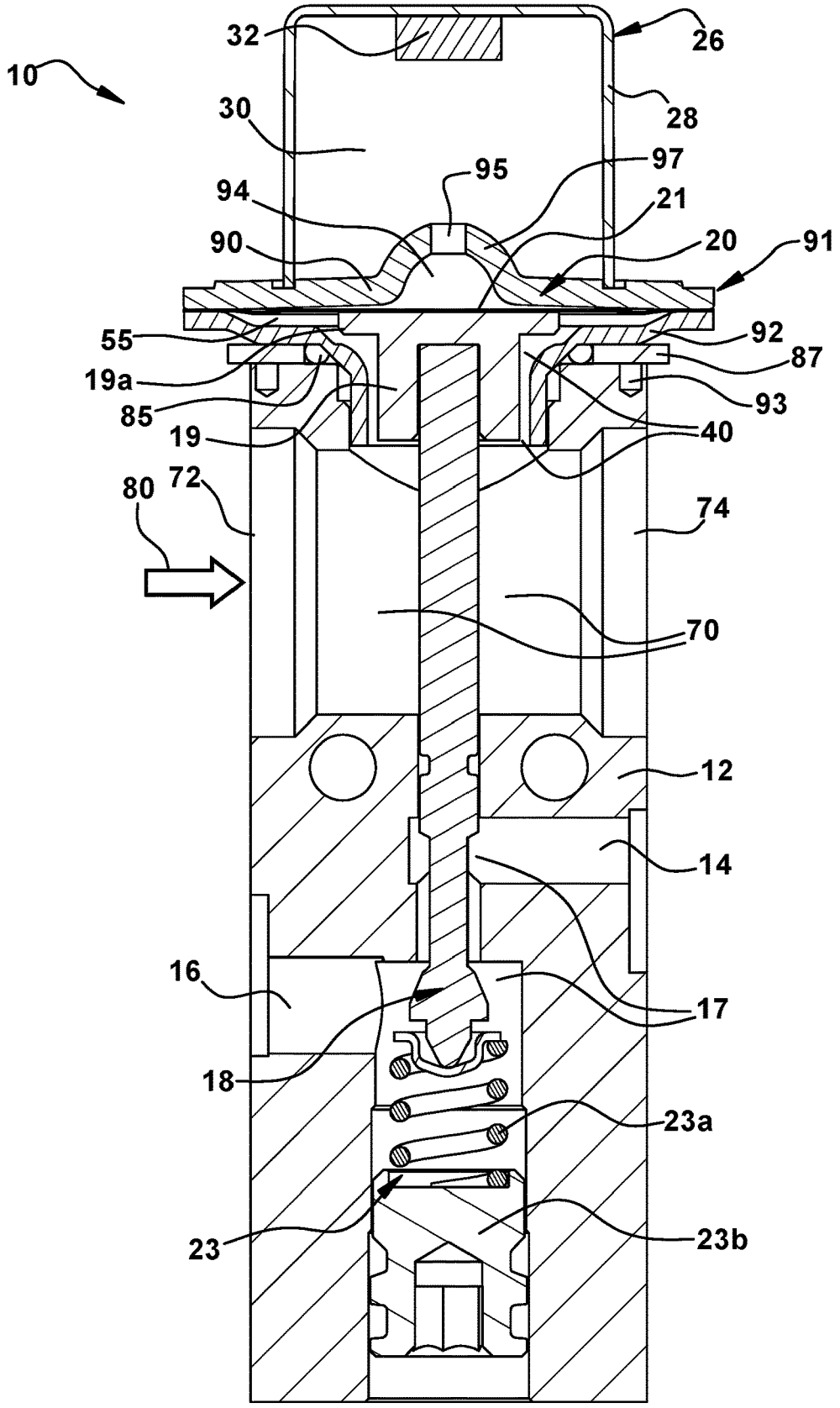
FIG. 12 is a cross-sectional side view of another embodiment of a bulbless TEV according to an embodiment of the present disclosure.

Referring initially to FIG. 12, an exemplary embodiment of a TEV 10 is shown, including valve body 12 having inlet 14 and outlet 16, and a valve member 18 coupled to a power element 20 for controlling movement of the valve member 18 to thereby control flow of operating fluid through the valve body 12. The TEV 10 also includes thermal sensor 26 operatively mounted to the power element 20, in which the thermal sensor 26 includes sensor enclosure 28 that at least partially forms the sensing chamber 30 that contains a sensing fluid.

In the illustrated embodiment, the valve body 12 is constructed as a block-style valve, in which the inlet 14 is configured to receive operating fluid in the form of liquid downstream of a condenser. The valve member 18 is movable relative to the valve body 12 in response to actuation by the power element 20 to thereby control operating fluid flow through the flow path 17 from the inlet 14 to the outlet 16. The power element 20 may modulate the valve member 18 to modulate fluid flow control and cause expansion of the operating fluid (e.g., liquid refrigerant) across the valve member 18 causing the operating fluid to expand and cool. The expanded liquid-vapor mixture of the operating fluid then exits the outlet 16 of the valve 12 and passes downstream such as to the evaporator (FIG. 1) for cooling an area in the manner described above.

As shown, the valve body 12 also includes a second inlet 72, a second outlet 74 and second fluid passage 70 for flow of operating fluid between the inlet and outlet. In the illustrated embodiment, the second inlet 72 is connected to the outlet of the evaporator for receiving operating fluid vapor which passes through the passage 70 and out of the second outlet 74 for being received by the compressor. As such, the valve body 12 is constructed such that the second passage 70 forms a segment of suction line 80. As shown, the valve body 12 may be constructed to provide a relatively short path from the suction line 80 (passage 70) to the power element 20 to improve responsiveness and control of the valve 10.

The valve member 18 may have any suitable valve structure, such as a poppet valve or pin that can seat against a valve seat for opening, closing or modulating flow through the flow path 17. In the illustrated embodiment, the valve member 18 includes an elongated stem portion that extends through the valve body 12 across the flow path 70 to an opposite (e.g., upper) end portion 19 of the valve member 18. As shown, the end portion 19 of the valve member may include suitable abutments 19*a*, or stops, such as shoulder portions or the like.

The power element 20 is operatively mounted to the valve body 12, such as being attached via suitable fasteners (not shown) that are received in corresponding receivers 93. As shown, the power element 20 includes a casing 91 and a diaphragm 21 operatively coupled to the casing 91. The casing 91 includes a first part 90 (e.g., upper portion or cover) overlying the diaphragm 21, and includes a second part 92 (e.g., lower portion) underlying the diaphragm 21. The casing 91 may be configured to hold the diaphragm 21 in position, such as by sandwiching an outer peripheral portion of the diaphragm 21. The diaphragm 21 may be fixedly attached, such as by welding or otherwise adhering, portions of the diaphragm 21 to the casing 91.

As shown, the diaphragm 21 is operatively coupled to the valve member 18, such as being directly or indirectly attached to a first side (e.g., underside) of the diaphragm 21. The diaphragm 21 may have any suitable structure and be made of any suitable material for enabling movement of the valve member 18 in response to force applied to the diaphragm 21. For example, the diaphragm 21 may be made of a thin sheet or sheets of material that are configured to flex or bow in response to a force applied to the diaphragm 21, as described in further detail below. The diaphragm 21 may be made off a suitable material, such as metal, which is impermeable to liquid or gas.

The thermal sensor 26 of the TEV 10 is operatively mounted to, or integrated with, the casing 91 of the power element 20; although the sensor 26 could be integrated with or operatively mounted to the valve body 12. In this manner, the sensor enclosure 28 may be supported by the valve body 12, or the valve body 12 may be supported by the sensor enclosure 28. In the illustrated embodiment, for example, the sensor enclosure 28 is in the form of a dome mounted atop the power element 20 and which is directly attached to the casing 91 of the power element 20. The diaphragm 21 of the power element 20 serves as a partition that together with at least a portion of the sensor enclosure 28 forms and encloses the sensing chamber 30 to contain the sensing fluid therein. In exemplary embodiments, the sensor chamber 30 is formed as a closed thermodynamic system in which there is no mass flow into or out of the chamber 30 during operation of the valve. In this manner, the sensor enclosure 28 may be attached to the casing 91 of the power element 20 with a suitable connection, such as a gas impermeable weld. The TEV 10 is configured such that changes in temperature of the sensing fluid in the sensing chamber 30 results in contraction or expansion of the sensing fluid which changes the pressure in the chamber 30 and therefore the force applied to the diaphragm 21 of the power element 20. The changes in pressure cause the diaphragm 21 to move (e.g., flex or bow), which in turn exerts force on the valve member 18 to further open or further close the TEV 10. As shown, the TEV 10 may further include an adjustment mechanism 23, such as a spring-biased adjuster including a spring 23*a* and threaded pin 23*b*, whereby the spring force combines with fluid pressure at the underside of that diaphragm for counteracting the pressure from the sensing chamber 30 and thereby setting a desired control setpoint of the TEV 10.

The sensing fluid charged into the sensing chamber 30 may be any suitable fluid, such as a gas that can expand or contract in response to temperature changes. In exemplary embodiments, the sensing fluid is a refrigerant, which may be the same type or different type of refrigerant as the operating fluid. The sensing chamber 30 also may contain a ballast material 32 therein, although in some embodiments a ballast material 32 is not required. The ballast material 32 may be any suitable ballast, such as a porous ceramic block or beads that adsorbs/desorbs the sensing fluid. The thermal ballast 32 can slow how fast the temperature and the related pressure in the sensing chamber 30 changes. This slows down the reactivity of the TEV 10 and stabilizes the output of the valve during operation. The amount and the type of ballast 32 can be tailored to attain a specific superheat control desired.

In exemplary embodiments, the TEV 10 is configured such that heat energy transfers across the diaphragm 21 between the sensing fluid in the sensing chamber 30 that is in communication with the first (upper) side of the diaphragm and a region in communication with the second (under) side of the diaphragm 21. The region at the opposite second side of the diaphragm 21 may be in communication with an operating line of the system such that the temperature of the operating fluid communicates with the sensing fluid in the sensing chamber 30 across the diaphragm 21. In this manner, the region at the opposite (under) side of the diaphragm 21 may be an open thermodynamic system including mass and heat flow. In exemplary embodiments, a fluid flow passage 40 is provided to fluidly connect the operating line, such as the suction line, to the region at the second (under) side of the diaphragm 21. The changes in temperature of the sensing fluid in the sensing chamber 30 resulting from the exchange of heat energy results in increasing or decreasing the pressure in the sensing chamber 30 and thus the force generated at the first (upper) side of the diaphragm 21. The region at the opposite (under) side of the diaphragm 21 (e.g., in fluid communication with the operating line) exerts an opposite force to the second (under) side of the diaphragm 21. The diaphragm 21 of the power element 20 and thereby the valve member 18 move in response to the pressure differentials on the opposite sides of the diaphragm 21.

In exemplary embodiments, the configuration of the casing 91 of the power element 20 enables improved control of the TEV 10. For example, as shown in the illustrated embodiment, the casing 91 is constructed to hold the radially outer peripheral portion of the diaphragm 21 to constrain movement of the diaphragm 21. The first (upper) part 90 of the casing 91 and/or the second (lower) part 92 of the casing may extend radially inwardly to further constrain flexure of the diaphragm 21 as may be desired. As shown, a radially inward portion of the upper part 90 may be closely arranged to the upper side of the diaphragm and may slightly taper upwardly toward center to permit a desired amount of flexure of the diaphragm 21. A radially inward portion of the lower part 92 of the casing 91 also may be constructed to permit a desired amount of flexure of the diaphragm 21. The upper side communicating with the sensing chamber 30 may be closer than the opposite side, as shown, to permit more downward flexure than upward flexure of the diaphragm 21.

To provide suitable fluid communication with the sensing chamber 30 and/or a desired amount of fluid pressure at the upper side of the diaphragm 21, the first (upper) part 90 of the casing 91 may be configured to provide a first (e.g., upper) chamber 94 formed by at least a portion of the first (upper) part 90 of the casing together with at least a portion of the upper side of the diaphragm 21. In the illustrated embodiment, a dome-shaped protrusion 97 forms at least part of the upper chamber 94 and includes an orifice 95 for providing fluid communication with the sensing chamber 30. The size of the chamber 94 and/or size of the orifice 95 may be adapted to control the pressure at the upper side of diaphragm 21, such as to slow reactivity of the TEV 10, for example.

To provide suitable fluid communication with the underside of the diaphragm 21, the second (lower) part 92 of the casing 91 may be configured to provide a second (e.g., lower) chamber 55 formed by at least a portion of the second (lower) part 92 of the casing together with at least a portion of the underside of the diaphragm 21. In this manner, the diaphragm 21 serves as a divider that divides the internal chamber of the casing 91 into the first (e.g., upper) chamber 94 and the second (e.g., lower) chamber 55, and is configured to permit transfer of heat energy but restrict transfer of fluid from the sensing chamber 30 and upper chamber 94 to the lower chamber 55. As shown, the lower part 92 of the casing 91 may provide a seat or stop for the shoulder portion 19*a* of the upper portion 19 of the valve member 18 to control movement thereof. A suitable seal 85, such as an O-ring seal, may be arranged between the valve body 12 and the power element 20 to provide a suitable seal.

As noted above, the region at the underside of the diaphragm 21 (e.g., the lower fluid chamber 55) may be fluidly connected to an operating line of the system via a fluid flow passage 40 so that the TEV 10 is reactive to adjust the valve member 18 in response to temperature and pressure of the operating fluid flowing through the operating line. In the illustrated embodiment, the operating line is the suction line 70, 80 in which operating fluid (e.g., refrigerant vapor) is routed through the passage 40 which is formed as an internal passage in the valve body 12. As shown, the passage 40 may be formed at least partially by a vertical bore that contains the upper portion 19 of the valve member 18. The passage 40 connected to the suction line of the system also may be referred to as an internal equalization passage or equalization line. The fluid (e.g., refrigerant vapor) may flow through the passage 40 into the chamber 55 to be in direct contact with the diaphragm 21 and permit heat energy transfer across the diaphragm 21 with the sensing fluid in the sensing chamber 30 via upper chamber 94. The diaphragm 21 may be a conductive material, such as metal, to facilitate such heat transfer. The power element 20 is responsive to forces acting on opposite sides of the diaphragm 21 via pressure changes in each of the lower 55 and upper 94/30 chambers to thereby adjust position of the valve 18 and control flow between inlet 14 and outlet 16.

In some cases, outside temperature influences on the sensing fluid in the sensing chamber 30, other than that transferred through the diaphragm 21, could affect the reactivity and control of the TEV 10. As such, in exemplary embodiments, it may be beneficial to thermally isolate the enclosure 28 of the sensing chamber 30 in one or more ways. For example, in exemplary embodiments, the sensor enclosure 28 is spaced apart from one or more, or all, operating lines of the system, such as the suction line 70, 80 which may contain hot evaporated refrigerant. This may be accomplished, for example, by arranging the sensor enclosure 28 to not intersect with a flow path of operating fluid flowing through the valve body. In the illustration, for example, the sensor enclosure 28 is operatively mounted to the valve body 12 such that the casing 91 of the power element 20 is arranged between the enclosure 28 and the valve body 12. The operating fluid flows through passages 17 and 70 and thus does not intersect with the enclosure 28, but instead provides heat transfer with the sensing chamber 30 via the flow passage 40 and diaphragm 21 in the manner described above. Such a configuration can reduce the reactivity of the TEV 10, which may be useful to prevent overshooting or hunting phenomena.

To further isolate the enclosure 28 and sensing chamber 30 from unwanted heat transfer, a thermal damper 87 may be arranged between the sensor enclosure 28 and the operating line (e.g., 70). The thermal damper may be made from any suitable material in any suitable form that reduces heat transfer (e.g., conduction) between the two members, and more specifically, may be designed to reduce reactivity of the TEV 10 by thermally insulating the sensing chamber 30. For example, the thermal damper may be in the form of a thermal insulator made from a suitable thermally insulative material having a low thermal conductivity (e.g., less than 50 W/mK; more particularly less than 10 W/mK; or less than 1.0 W/mK; or less than 0.50 W/mK, such as in a range from 0.01-50 w/mK, for example). The thermal damper may be in the form of a spacer positioned between the two members, or may be a coating or other suitable structure arranged between the two members. Non-limiting examples of such thermally insulative materials may include, for example, polymers (e.g., nylon, PEEK, PTFE, silicone, etc.), glass (e.g., fiberglass), ceramics (e.g., alumina, silica, etc.), minerals (e.g., mineral wool), foams, or the like. Alternatively or additionally, the thermal damper may be formed as a structure (e.g., spacer, coating, etc.) with an increased thickness between the two members to reduce heat conduction. Such a thermal damper with increased thickness may or may not be an insulative material, but instead may be a thermally conductive material (such as metal) having sufficient thickness to reduce heat transfer to the sensing chamber 30.

In the illustrated embodiment, in which the operating line is formed by part of the valve body 12, the thermal damper 87 is formed as an insulative spacer 87 that is arranged between the sensor enclosure 28 and the valve body 12. The thermal insulator 87 may be made from any suitable thermally insulative material, such as a polymer (e.g., nylon, PEEK, PTFE, silicone, etc.), or other suitable material having low thermal conductivity. As shown, the insulative spacer 87 may be arranged between the casing 91 of the power element 20 and the valve body 12. This restricts heat transfer from the valve body 12 and improves the control of the TEV 10. More specifically, as shown in the illustrated embodiment, the thermally insulative spacer 87 is arranged, along with the seal 85, at location between the lower casing portion 92 and the valve body 12 at a position that is radially outward of a longitudinal axis of the valve member 18. As such, the thermally insulative spacer arrangement has a radially inner portion, and the thermally insulative spacer arrangement is configured to prevent direct contact of the lower casing portion 92 with the valve body 12 at all respective points of the lower casing portion and the valve body that are located radially outwardly relative to the radially inner portion of the thermally insulative spacer arrangement.

The configuration of the TEV 10 provides numerous advantages. For example, the block-style of the valve 10 incorporates the suction line 70, 80 which may make it easier to assembly into the system. The TEV 10 may also be lower cost because it contains fewer parts. The thermal coupling of the suction line 70, 80 to the sensor chamber 30 via the flow passage 40 allows for elimination of the bulb and capillary tube in conventional TEV installations and the problems associated therewith. For example, the elimination of the bulb eliminates issues associated with poor attachment of the bulb on the suction line, which is typically accomplished with a metallic clamp often resulting in discontinuous contact with the suction line and results in the valve failing to control superheat as intended. The TEV 10 with the thermal sensor 26 described herein provides more predictable thermal communication than prior bulb designs. The elimination of the capillary tube also eliminates issues with capillary tube breakage or charge migration in the capillary tube (condensation in the capillary tube). In addition, the equalizer line (passage 40) is used to sense pressure of the suction line, and by providing a relatively short path between the suction line and power element 20, issues such as clogging, cooling, etc. may be minimized.

Turning now to FIGS. 2-11, other exemplary embodiments of TEVs 10 are shown, which share similarities with the TEV 10 in FIG. 12, and thus share similar advantages. It is understood that the foregoing description of the TEV 10 in FIG. 12 is equally applicable to the TEVs 10 in FIGS. 2-11, except as noted below, and aspects of the TEVs 10 may be substituted for one another or used in conjunction with one another where applicable.

Figure 2:
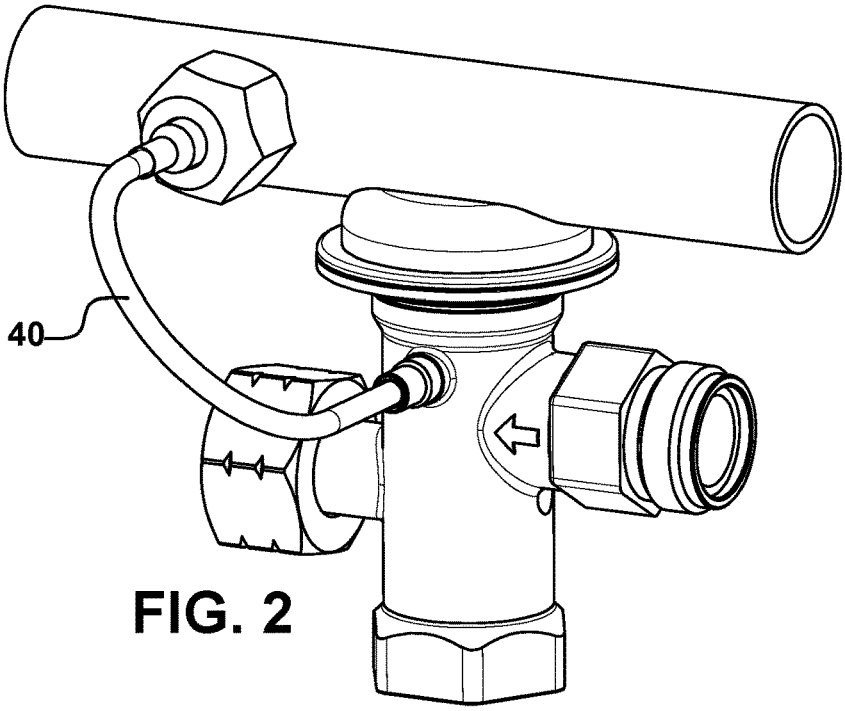
FIG. 2 is a perspective view of an exemplary embodiment of a bulbless TEV according to an embodiment of the present disclosure.
Figure 3:
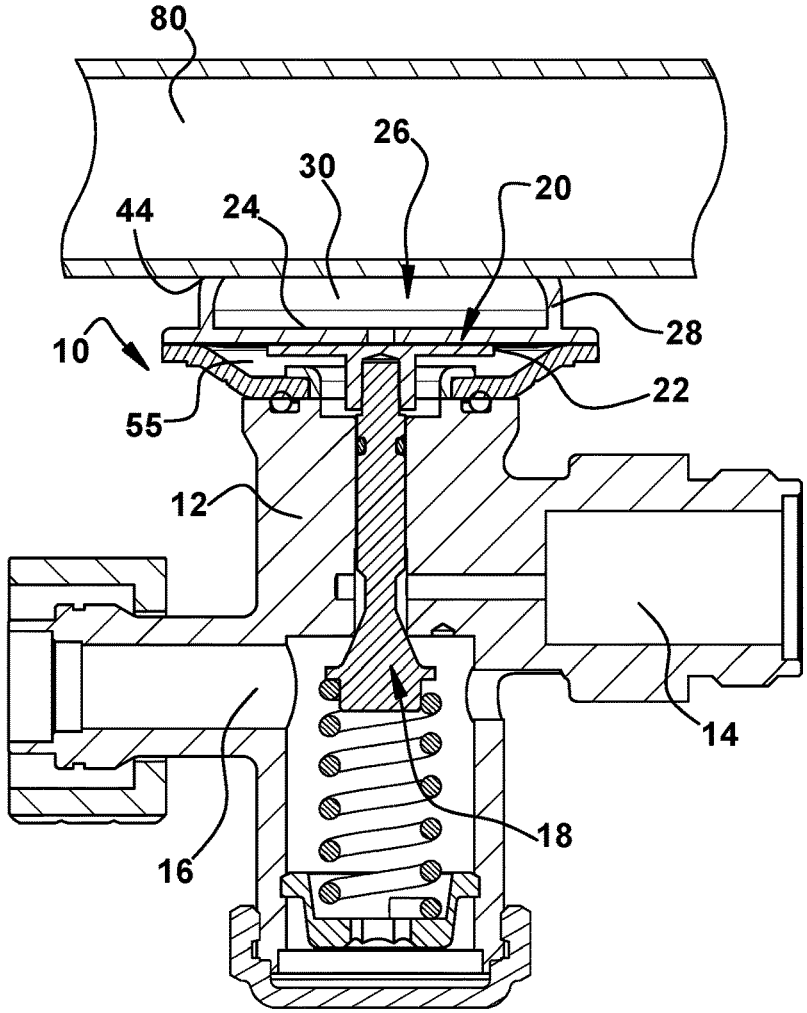
FIG. 3 is a cross-sectional side view of the TEV in FIG. 2.

Referring to FIGS. 2 and 3, an exemplary embodiment of a bulbless TEV 10 is shown. The TEV 10 includes a valve body 12 having an inlet 14 and an outlet 16 and a sensor housing 28, such as a dome, that is closely coupled to a thermal member (such as a suction line 80 of a system) of the system. The sensor enclosure 28 is closely coupled to the suction line 80 by a weld 44. It is understood, however, that the sensor enclosure 28 could be operatively mounted to the suction line 80 with a thermal damper (not shown) arranged between the sensor enclosure 28 and suction line 80 to insulate the enclosure 28. The thermal damper may be the same or similar to the type (e.g., damper 87) described above. For example, to couple the sensor enclosure 28 to the suction line 80 with a weld, the thermal damper may be a weldable metal (e.g., copper) having sufficient thickness that reduces heat conduction from the suction line 80 to the sensor enclosure 28.

The valve also includes a power element 20, which may include a diaphragm 21 and a chamber 42 or housing portion above and/or below the diaphragm 21. The diaphragm 21 is coupled to a valve member 18 which is actuated based on pressures acting on the diaphragm to adjust flow restrictions through the valve. The valve also includes an equalizer line 40 that transmits pressure from the suction line back to the valve and places the pressure underneath the diaphragm 21. The equalizer line 40 may be shorter than conventional TEV designs due to the close coupling of the valve with the suction line. The valve also may include a charge tube, which can be used to supply the sensing fluid such as vapor refrigerant to the sensing chamber 30. As shown, the thermal sensor housing 28 that contains the sensing fluid (and optionally ballast 32) does not intersect with (or is located outside of) operating fluid flow, such as operating fluid flowing through the suction line 80, which can slow the reactivity of the TEV 10.

Figure 4A:
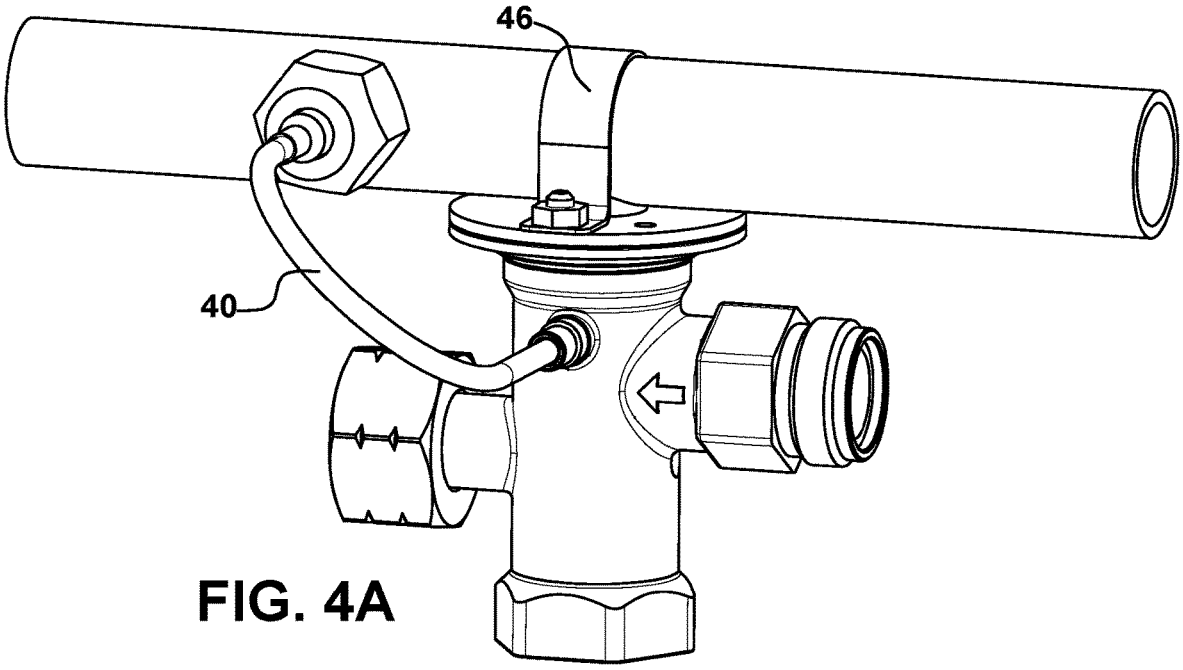
FIG. 4A is a perspective view of another embodiment of a bulbless TEV according to an embodiment of the present disclosure.
Figure 4B:
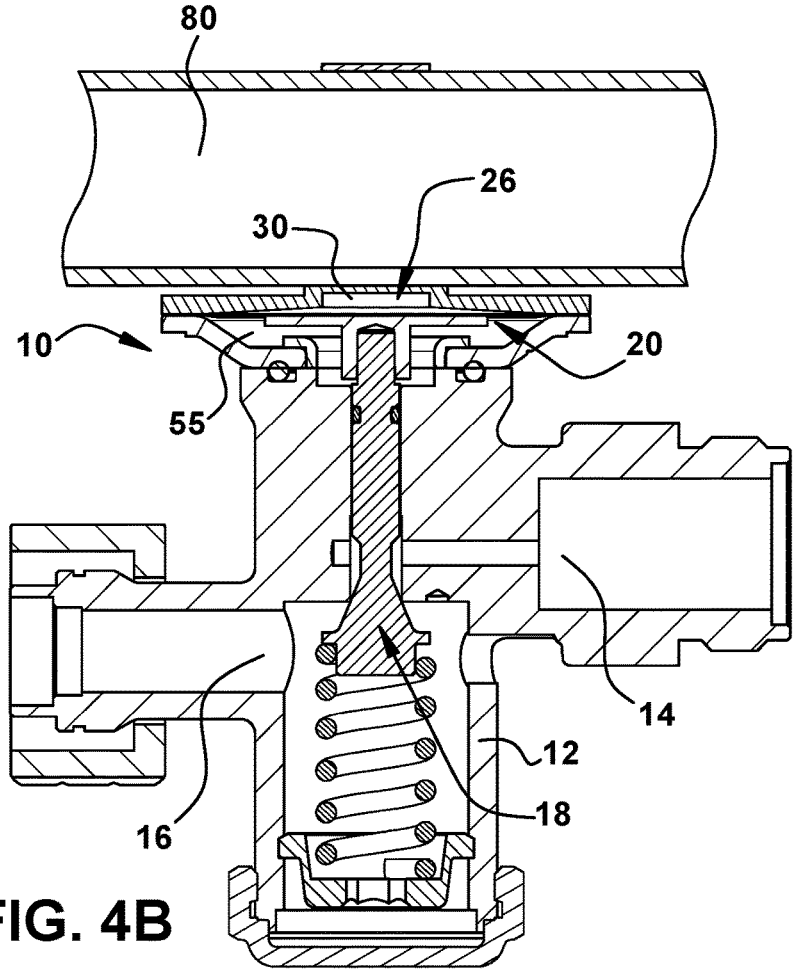
FIG. 4B is a cross-sectional side view of the TEV in FIG. 4A.

The TEV 10 shown in FIGS. 4A and 4B are similar to the TEV 10 in FIG. 3, except that the sensor enclosure 28 is closely coupled to the thermal member by a strap connection 46. It is understood, however, that the sensor enclosure 28 could be operatively mounted to the suction line 80 with a thermal damper (not shown) arranged between the sensor enclosure 28 and suction line 80 to insulate the enclosure 28. The thermal damper may be the same or similar to the type (e.g., damper 87) described above.

Figure 5A:
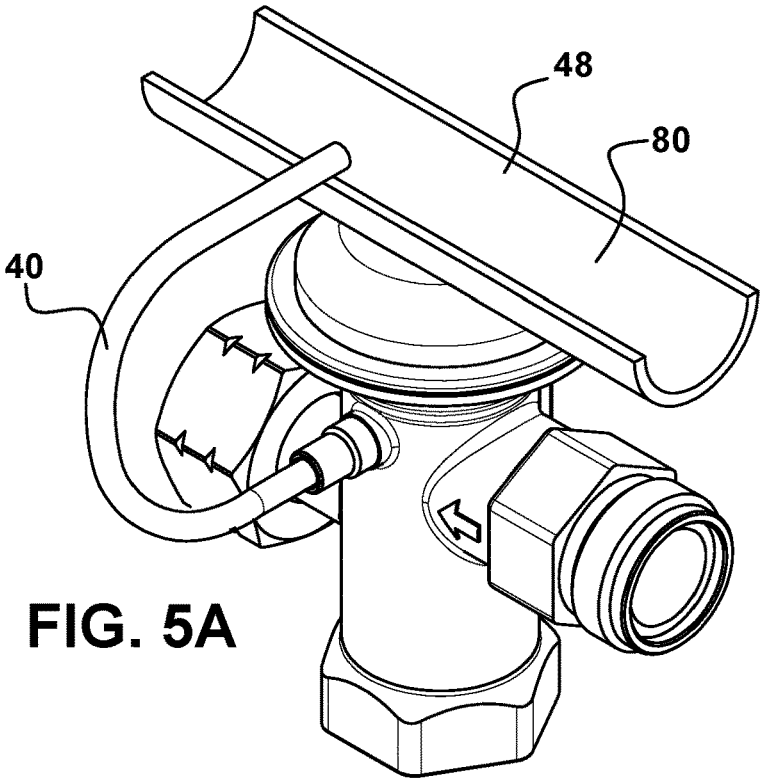
FIG. 5A is a perspective view of another embodiment of a bulbless TEV according to an embodiment of the present disclosure.
Figure 5B:
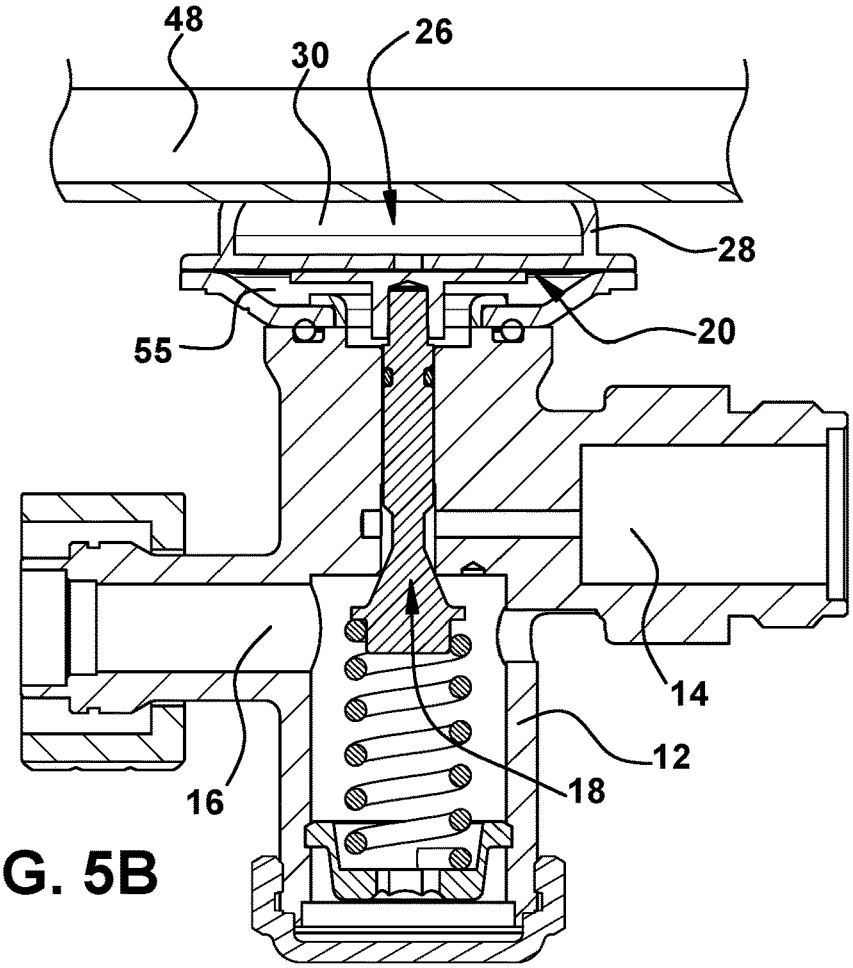
FIG. 5B is a cross-sectional side view of the TEV in FIG. 5A.

In the embodiment of FIGS. 5A and 5B, the valve includes a saddle 48 coupled to the sensor enclosure 28, and the sensor enclosure 28 is closely coupled to the thermal member by the saddle. It is understood, however, that the sensor enclosure 28 could be operatively mounted to the suction line 80 with a thermal damper (not shown) arranged between the sensor enclosure 28 and suction line 80 to insulate the enclosure 28. The thermal damper may be the same or similar to the type (e.g., damper 87) described above.

Figure 6:
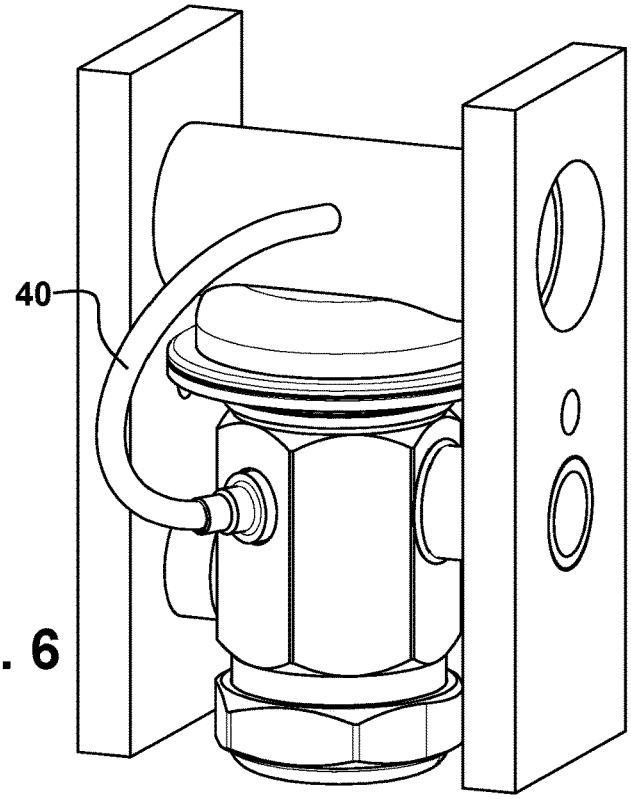
FIG. 6 is a perspective view of another embodiment of a bulbless TEV according to an embodiment of the present disclosure.
Figure 7:
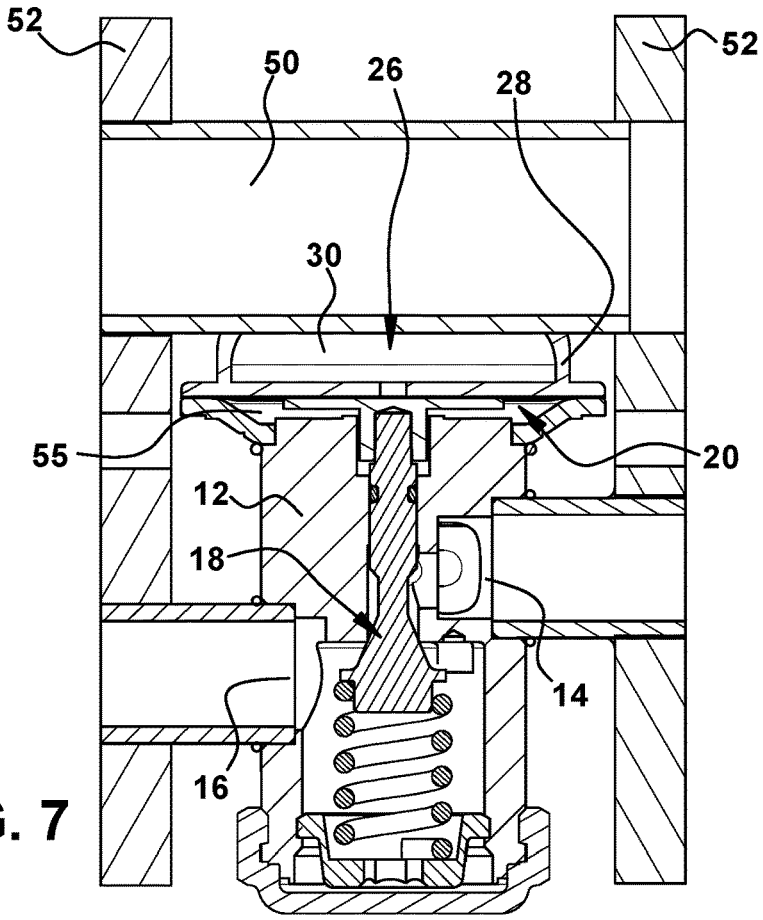
FIG. 7 is a cross-sectional side view of the TEV in FIG. 6.

In the embodiment of FIGS. 6 and 7, a separate tube segment 50 is coupled to the sensor housing 28, and one or more flanges 52 are disposed on either side of the tube. The sensor housing 28 is closely coupled to the thermal member via the tube and flanges, which can be installed to correspond with the other tubular components of the system. As shown, similarly to the embodiments in FIGS. 2-5, the thermal sensor enclosure or housing 28 that contains the sensing fluid (and optionally ballast 32) does not intersect with (or is located outside of) operating fluid flow, such as operating fluid flowing through the suction line 80, which slows the reactivity of the TEV.

Figure 8:
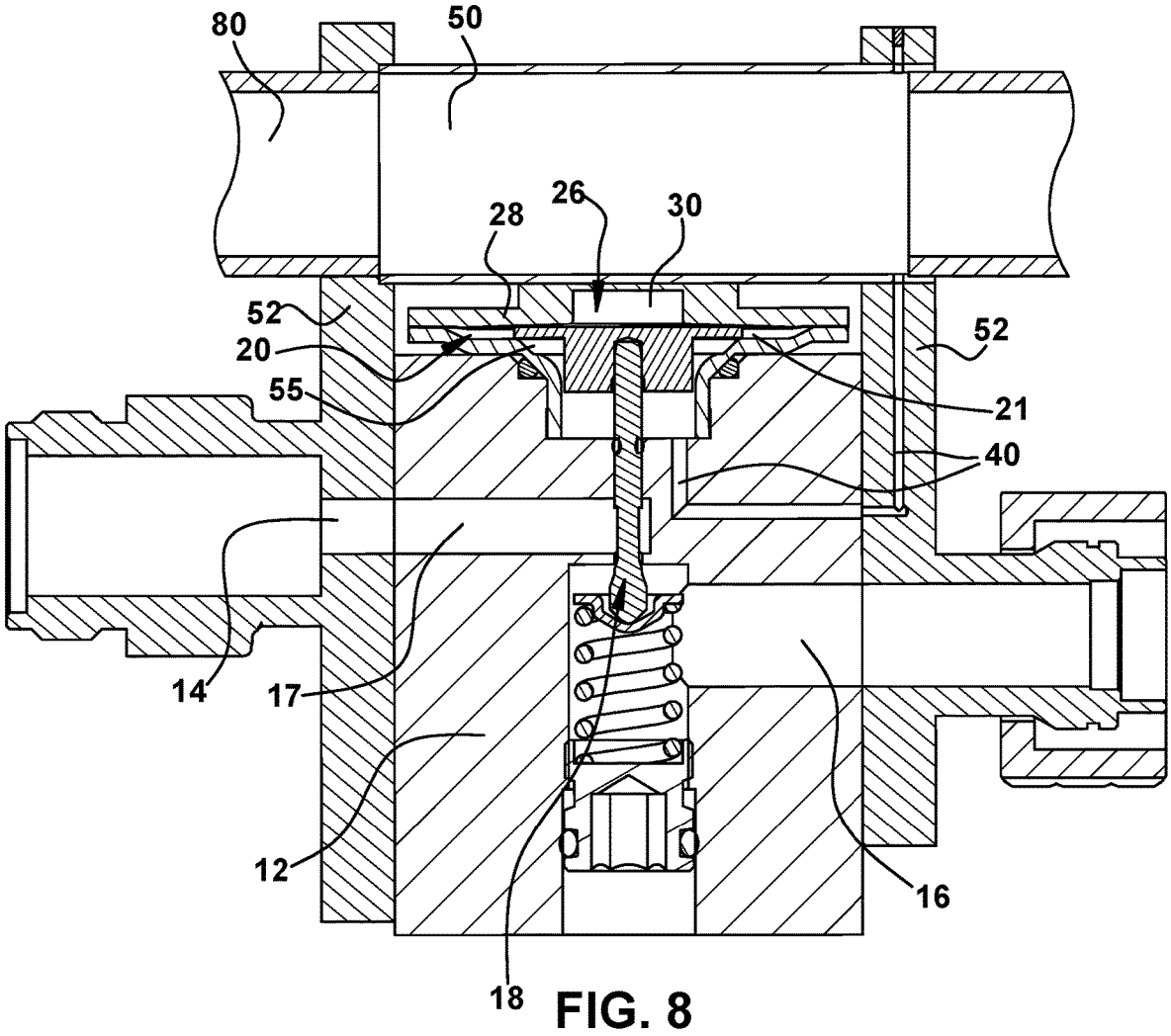
FIG. 8 is a cross-sectional side view of another embodiment of a bulbless TEV according to an embodiment of the present disclosure.
Figure 9:
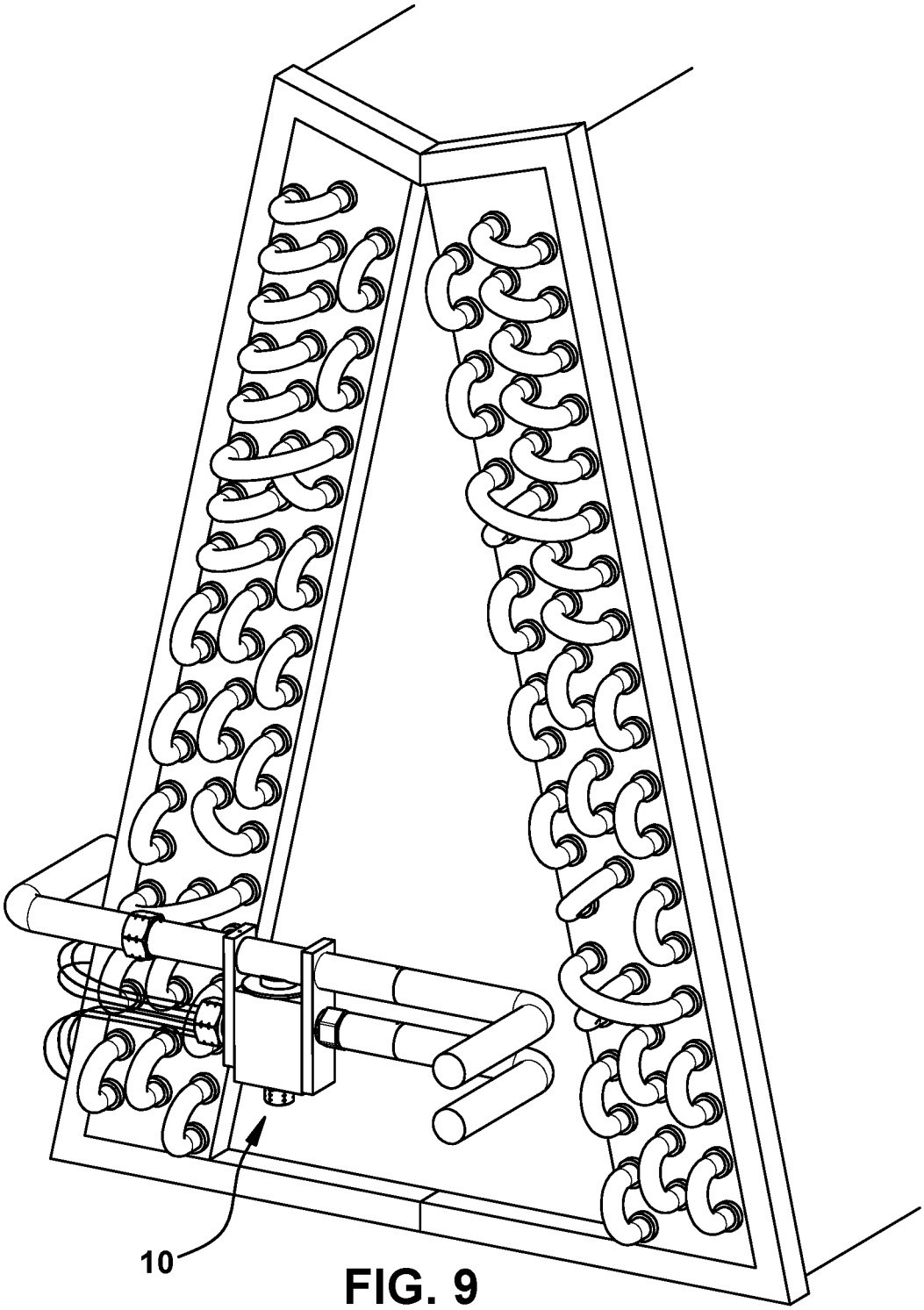
FIGS. 9 and 10 illustrate exemplary installations of the TEV in FIG. 8 into an exemplary system having an evaporator as shown.
Figure 10:
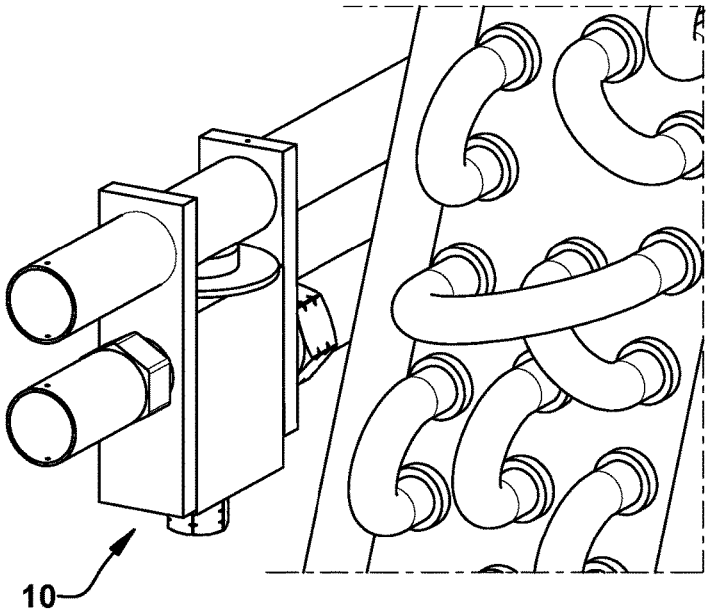

As shown in FIG. 8, the flange can include an equalizer line 40, which may be integrally formed or machined into the flange 52 such that the suction line 80 is in fluid communication with the power element 20 of the TEV. The hole from the top of the flange 52 may be plugged prior to placing the valve in service. A portion of the passage 40 also is formed as part of the valve body 12. The thermal sensor housing 28 that contains the sensing fluid (and optionally ballast 32) does not intersect with (or is located outside of) operating fluid flow, such as operating fluid flowing through the suction line 80, which slows the reactivity of the TEV. FIGS. 9 and 10 show the bulbless TEV in FIG. 8 in an exemplary installation.

Figure 11:
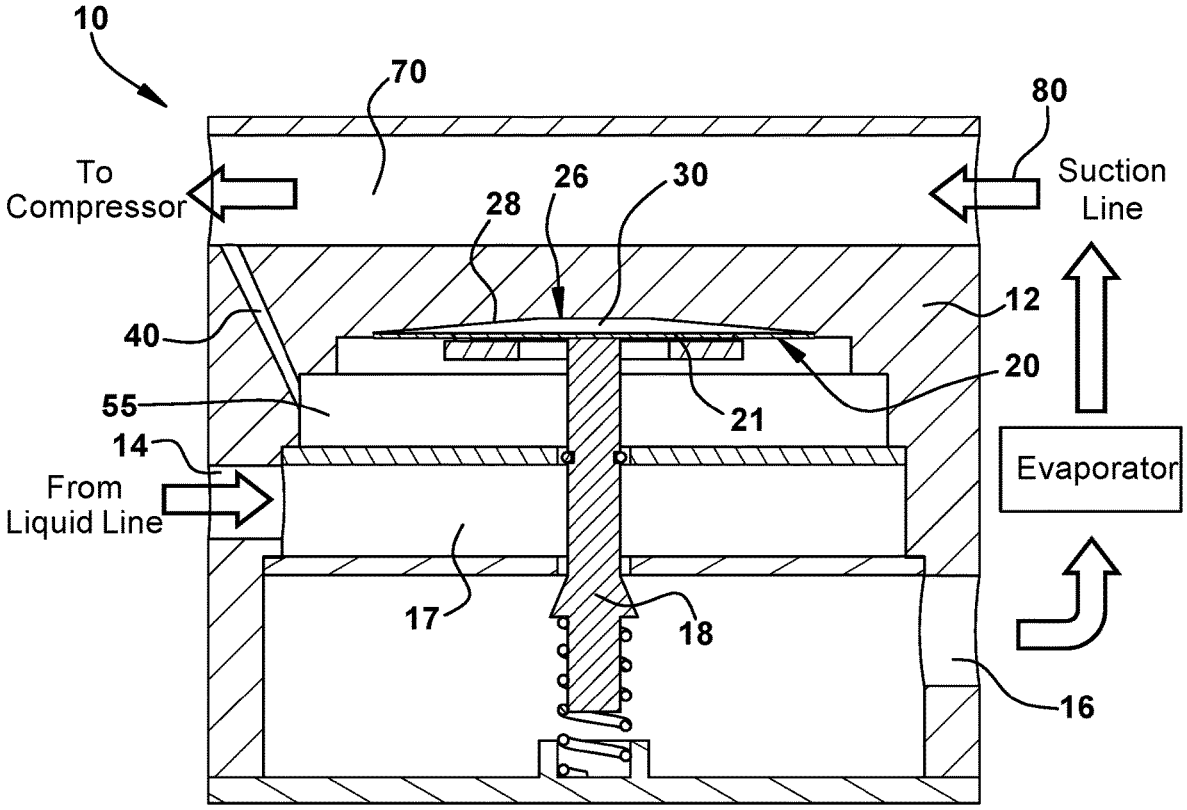
FIG. 11 is a cross-sectional side view of another embodiment of a bulbless TEV according to an embodiment of the present disclosure.

In the embodiment of FIG. 11, the valve body 12 includes first inlet 14, first outlet 16 and first fluid flow passage 17 for flow of operating fluid between the first inlet and outlet; and includes a second inlet 72, second outlet 74 and second fluid passage 70 for flow of operating fluid between the inlet and outlet, in which the second passage 70 forms a segment of the suction line 80. In this manner, the first inlet 14 is configured to receive operating fluid in the form of liquid downstream of a condenser; the valve member 18 is movable in response to the power element 20 in the first fluid flow path for controlling operating fluid flow from inlet 14 to outlet 16 and downstream to an evaporator; and the second inlet 72 is configured to receive operating fluid in the form of vapor downstream of the evaporator which passes via the second passage (flow path) 70 in the valve body 12 downstream through the second outlet 74.

As shown, the pressure from the suction line 70, 80 is routed through a passage 40 that is formed as an internal passage in the valve body 12. The passage 40 may be created by drilling a single hole through the body 12 of the valve. This connects to a lower chamber 55 below the diaphragm 21 of the power element 20. In the illustrated embodiment, the thermal sensor enclosure 28 that contains the sensing fluid (and optionally ballast 32) is formed by a portion of the valve body 12, and this portion does not intersect with (or is located outside of) operating fluid flowing through passage 70, which forms a segment of the suction line 80. The sensing fluid in the sensing chamber 30 exerts a force in response to change in pressure on the upper side of the diaphragm 21 opposite the force provided by the lower chamber 55.

Exemplary bulbless thermal expansion valves have been described herein, in which according to an aspect, the expansion valve includes a valve body, a valve member, a power element, and a thermal sensor including an enclosure operatively mounted to the valve body. The power element includes a diaphragm having a first side operatively coupled to the valve member, and a second side that together with the sensor enclosure forms at least part of a sensing chamber containing sensing fluid such that the sensing fluid is in communication with the second side of the diaphragm. The first side of the diaphragm may be fluidly coupled to an operating line, such as a suction line, to communicate temperature and pressure to the first side of the diaphragm, thereby providing heat transfer with the sensing fluid on the opposite side. Temperature changes of the sensing fluid results in pressure changes applied to the diaphragm causing movement of the valve member to control flow of the operating fluid.

According to another aspect, a thermal expansion valve for a system includes a valve body having at least one inlet, at least one outlet, and one or more fluid flow paths; a valve member movable relative to the valve body for controlling flow of operating fluid through at least one of the one or more flow paths; a power element including a casing and a diaphragm operatively coupled to the casing, the diaphragm of the power element being operatively coupled to the valve member for effecting movement of the valve member and thereby controlling flow of the operating fluid through the valve body; and a thermal sensor including an enclosure forming at least a portion of a sensing chamber that contains a sensing fluid; wherein at least a portion of a first part of the casing together with at least a portion of a first side of the diaphragm form at least a portion of a first fluid chamber, the first fluid chamber being fluidly connected to an operating line of the system to fluidly communicate with operating fluid passing through the operating line; wherein at least a portion of a second part of the casing together with at least a portion of a second side of the diaphragm form at least a portion of a second fluid chamber, the second fluid chamber being fluidly connected to the sensing chamber of the thermal sensor to fluidly communicate with the sensing fluid; wherein the casing of the power element is arranged between the enclosure of the thermal sensor and the valve body, the enclosure of the thermal sensor being operatively mounted to the second part of the casing, and the first part of the casing being operatively mounted to the valve body; and wherein the expansion valve is configured such that heat energy is transferable across the diaphragm between the operating fluid communicating with the first chamber on the first side of the diaphragm and the sensing fluid communicating with the second chamber on the second side of the diaphragm, and such that changes in temperature of the sensing fluid results in changes in pressure at the second side of the diaphragm which generates a force on the diaphragm that causes movement of the valve member in response to the changes in force on the diaphragm resulting from the changes in temperature of the sensing fluid.

Embodiments may include one or more features of the foregoing aspects in combination with one or more of the following additional features, which may be combined separately or in any combination.

In exemplary embodiments, the expansion valve is devoid of a sensing bulb and external capillary tube, and the sensing fluid is contained entirely in the sensor enclosure as a self-contained closed thermodynamic system.

In exemplary embodiments, the sensor enclosure is formed as a dome that is mounted to the power element in which the power element is mounted to the valve body.

In exemplary embodiments, the sensor enclosure is adapted to be operatively mounted to a suction line of the system which is a refrigerant system; or wherein the valve body includes an internal fluid passage that forms a segment of the suction line.

In exemplary embodiments, a region at the first side of the diaphragm is configured to be in communication with an operating fluid of the system, such that heat is transferable across the diaphragm between the sensing chamber and the region at the first side, whereby changes in the temperature of the sensing fluid results in changes in pressure applied to the second side of the diaphragm, and pressure from the operating fluid is applied to the first side, wherein the diaphragm and thereby the valve member are configured to move in response to the pressure differential on the first and second sides of the diaphragm.

In exemplary embodiments, the expansion valve is configured such the inlet is fluidly connectable to a condenser for receiving a liquid refrigerant, the valve member is movable to control expansion of the liquid refrigerant to form a vapor-liquid mixture, and the outlet is fluidly connectable to an evaporator to transfer the vapor-liquid mixture to the evaporator.

In exemplary embodiments, the region at the first side of the diaphragm is fluidly connectable to a suction line downstream of the evaporator to receive refrigerant vapor and communicate temperature and pressure of the refrigerant vapor to the first side of the diaphragm.

In exemplary embodiments, the valve body includes a second inlet that is fluidly connectable to the suction line from the evaporator, a second outlet that is fluidly connectable to a compressor to pass the refrigerant vapor downstream to the compressor, and a fluid flow passage internal to the valve body for passing the refrigerant vapor from the inlet to the outlet.

In exemplary embodiments, the valve body includes second internal fluid flow passage that fluidly connects the fluid flow passage between the second inlet and outlet to the region at the first side of the diaphragm.

In exemplary embodiments, the power element includes a casing and the diaphragm is operatively coupled to the casing.

In exemplary embodiments, at least a portion of a first part of the casing together with at least a portion of a first side of the diaphragm form at least a portion of a first fluid chamber, the first fluid chamber being fluidly connected to an operating line of the system to fluidly communicate with operating fluid passing through the operating line.

In exemplary embodiments, at least a portion of a second part of the casing together with at least a portion of a second side of the diaphragm form at least a portion of a second fluid chamber, the second fluid chamber being fluidly connected to the sensing chamber of the thermal sensor to fluidly communicate with the sensing fluid.

In exemplary embodiments, the expansion valve is configured such that heat energy is transferable across the diaphragm between the operating fluid communicating with the first chamber on the first side of the diaphragm and the sensing fluid communicating with the second chamber on the second side of the diaphragm, and such that changes in temperature of the sensing fluid results in changes in pressure at the second side of the diaphragm which generates a force on the diaphragm that causes movement of the valve member in response to the changes in force on the diaphragm resulting from the changes in temperature of the sensing fluid.

In exemplary embodiments, a casing of the power element is arranged between the sensor enclosure and the valve body, the sensor enclosure being sealingly mounted to the second part of the casing to contain the sensing fluid, and the first part of the casing being operatively mounted to the valve body.

In exemplary embodiments, a casing of the power element is configured to control an amount of flex of the diaphragm.

In exemplary embodiments, the sensor enclosure does not intersect or is not directly coupled to an operating line of the system; more particularly a suction line of the system.

In exemplary embodiments, an internal fluid passage extends through the valve body to fluidly connect a region at the first side of the diaphragm with an operating fluid of the system.

In exemplary embodiments, a fluid conduit external to the valve body fluidly connects a region at the first side of the diaphragm with an operating fluid of the system.

In exemplary embodiments, the sensor enclosure is configured to be closely coupled to a suction line of the system by a weld.

In exemplary embodiments, the sensor enclosure is configured to be closely coupled to the suction line of the system by a strap connection.

In exemplary embodiments, the sensor enclosure is configured to be closely coupled to the suction line of the system by a saddle.

In exemplary embodiments, the sensor enclosure is configured to be closely coupled to the suction line of the system with a pair of flanges disposed on either side of the suction line.

In exemplary embodiments, the sensor chamber includes a ballast contained therein.

In exemplary embodiments, a thermal damper is arranged between the sensor enclosure and an operating line of the system; more particularly a suction line.

In exemplary embodiments, a thermal damper is arranged between the sensor enclosure and the valve body.

In exemplary embodiments, a thermal damper is arranged between the power element casing and the valve body.

In exemplary embodiments, the thermal damper is a thermal insulator, such as a thermally insulative spacer or coating.

In exemplary embodiments, the sensor enclosure is a dome with fully enclosed sides and a fully enclosed top, and is mounted atop the second part of the case of the power element to form the sensor chamber.

In exemplary embodiments, the second part of the casing has an opening through which the sensing fluid is communicated between the sensor chamber and the second chamber of the power element.

In exemplary embodiments, the second part of the casing has a dome shaped protrusion having the opening.

In exemplary embodiments, the dome of the sensor enclosure is not in direct contact with an operating fluid of the system.

As used herein, an "operative connection," or a connection by which entities are "operatively connected," is one in which the entities are connected in such a way that the entities may perform as intended. An operative connection may be a direct connection or an indirect connection in which an intermediate entity or entities cooperate or otherwise are part of the connection or are in between the operatively connected entities. An operative connection or coupling may include the entities being integral and unitary with each other.

It is to be understood that terms such as "top," "bottom," "upper," "lower," "left," "right," "front," "rear," "forward," "rearward," and the like as used herein may refer to an arbitrary frame of reference, rather than to the ordinary gravitational frame of reference.

The phrase "and/or" should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

The word "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," may refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A bulbless thermal expansion valve for a system, the expansion valve comprising:

a valve body having a first fluid passage extending between a first inlet and a first outlet of the valve body, and a second fluid passage extending between a second inlet and a second outlet of the valve body;

a valve member movable along a longitudinal axis relative to the valve body for controlling expansion of coolant flowing through the first fluid passage of the valve body;

a power element including a casing and a diaphragm coupled to the casing, the casing including a lower casing portion underlying the diaphragm and an upper casing portion overlying the diaphragm, the diaphragm having a first side operatively coupled to the valve member and a second side opposite the first side, wherein the second side of the diaphragm and the upper casing portion together form at least part of a sensing chamber that constitutes a thermal sensor of the expansion valve; and a thermally insulative spacer arrangement positioned between the lower casing portion and the valve body at a position that is radially outward of the longitudinal axis;

wherein the thermally insulative spacer arrangement has a radially inner portion, and the thermally insulative spacer arrangement is configured to prevent direct contact of the lower casing portion with the valve body at all respective points of the lower casing portion and the valve body that are located radially outwardly relative to the radially inner portion;

wherein the expansion valve is devoid of a remote sensing bulb; and wherein the sensing chamber contains a thermal sensing fluid in fluid communication with the second side of the diaphragm, such that changes in the temperature of the sensing fluid results in changes in pressure applied to the second side of the diaphragm, thereby causing movement of the diaphragm which provides movement of the valve member operatively coupled to the first side of the diaphragm.

2. The bulbless thermal expansion valve according to claim 1, wherein:

the radially inner portion of the thermally insulative spacer arrangement lies in a vertical plane that is parallel to the longitudinal axis;

the lower casing portion has a lower surface that faces the valve body and lies in a first horizontal plane that is transverse to the longitudinal axis; and the thermally insulative spacer arrangement is arranged between the lower casing portion and the valve body such that all points of the lower surface of the lower casing portion that are radially outward of the vertical plane do not directly contact any portion of the valve body.

3. The bulbless thermal expansion valve according to claim 2, wherein:

the valve body has an upper end surface that lies in a second horizontal plane that is transverse to the longitudinal axis;

the second horizontal plane and the first horizontal plane are parallel to each other, and a gap is formed between the lower surface of the lower casing portion and the upper end surface of the valve body; and the thermally insulative spacer arrangement is positioned in the gap.

4. The bulbless thermal expansion valve according to claim 3, wherein:

the radially inner portion of the thermally insulative spacer arrangement faces toward the longitudinal axis, the thermally insulative spacer arrangement also having a radially outer portion that is further from the longitudinal axis compared to the radially inner portion, and the gap is an open gap such that the radially outer portion faces away from the longitudinal axis toward an open space that is open to an area outside of the valve body.

5. The bulbless thermal expansion valve according to claim 1, wherein:

the lower casing portion is mounted to the valve body, and at least a portion of the lower casing portion together with at least a portion of the first side of the diaphragm form at least a portion of a fluid chamber that is fluidly connected to the second fluid passage of the valve body; and the thermally insulative spacer arrangement includes a sealing surface that sealingly engages against the lower casing portion to fluidly seal the fluid chamber.

6. The bulbless thermal expansion valve according to claim 5, wherein:

the thermally insulative spacer arrangement includes a seal having the sealing surface, and a spacer component that is discrete with respect to the seal.

7. The bulbless thermal expansion valve according to claim 6, wherein:

the spacer component is located radially outwardly of the seal and supports the seal.

8. The bulbless thermal expansion valve according to claim 7, wherein:

the spacer component and the seal are disposed in a gap that opens radially outwardly to an area outside the valve body.

9. The bulbless thermal expansion valve according to claim 6, wherein:

the seal is made with a first material; and the spacer component is made with a material that is different than the first material of the seal.

10. The bulbless thermal expansion valve according to claim 6, wherein:

the spacer component is made with a thermally insulative material selected from:

a polymer, a ceramic, a mineral, or a foam.

11. The bulbless thermal expansion valve according to claim 6, wherein:

the spacer component is made with a polymer material selected from nylon. polyether ether ketone (PEEK), polytetrafluoroethylene (PTFE), or silicone.

12. The bulbless thermal expansion valve according to claim 6, wherein:

the spacer component is made with a thermally insulative material having a thermal conductivity in a range from 0.01 W/m-K to 50 W/m-K.

13. The bulbless thermal expansion valve according to claim 1, wherein a dome enclosure is mounted to the upper casing portion, the dome enclosure forming at least part of the sensing chamber such that the dome enclosure constitutes an upper portion of the thermal sensor that forms a self-contained closed thermodynamic system.

14. The bulbless thermal expansion valve according to claim 1, wherein a ballast is mounted in the sensing chamber in spaced relation to the second side of the diaphragm.

15. The bulbless thermal expansion valve according to claim 1, wherein the thermally insulative spacer arrangement includes a spacer component that is made with a thermally insulative material having a thermal conductivity in a range from 0.01 W/m-K to 50 W/m-K.

16. A bulbless thermal expansion valve for a system, the expansion valve comprising:

a valve body having a first fluid passage extending between a first inlet and a first outlet of the valve body, and a second fluid passage extending between a second inlet and a second outlet of the valve body;

a valve member movable relative to the valve body for controlling expansion of coolant flowing through the first fluid passage of the valve body;

a power element including a casing and a diaphragm coupled to the casing, the casing including a lower casing portion underlying the diaphragm and an upper casing portion overlying the diaphragm, the diaphragm having a first side operatively coupled to the valve member and a second side opposite the first side, wherein the second side of the diaphragm and the upper casing portion together form at least part of a sensing chamber that constitutes a thermal sensor of the expansion valve;

wherein the lower casing portion is mounted to the valve body, and at least a portion of the lower casing portion together with at least a portion of the first side of the diaphragm form at least a portion of a fluid chamber that is fluidly connected to the second fluid passage of the valve body;

wherein a seal sealingly engages against the lower casing portion to fluidly seal the fluid chamber;

wherein a thermally insulative spacer or a thermally insulative coating is discrete with respect to the seal, and is arranged between the lower casing portion and an upper surface of the valve body to reduce heat transfer between the valve body and the casing;

wherein the expansion valve is devoid of a remote sensing bulb; and wherein the sensing chamber contains a thermal sensing fluid in fluid communication with the second side of the diaphragm, such that changes in the temperature of the sensing fluid results in changes in pressure applied to the second side of the diaphragm, thereby causing movement of the diaphragm which provides movement of the valve member operatively coupled to the first side of the diaphragm.

17. The bulbless thermal expansion valve according to claim 16, comprising the thermally insulative spacer, wherein:

the thermally insulative spacer is located radially outwardly of the seal and supports the seal.

18. The bulbless thermal expansion valve according to claim 16, wherein:

the seal is made with a first material; and the spacer component is made with a material that is different than the first material of the seal.

19. A bulbless thermal expansion valve for a system, the expansion valve comprising:

a valve body having a first fluid passage extending between a first inlet and a first outlet of the valve body, and a second fluid passage extending between a second inlet and a second outlet of the valve body;

a valve member movable relative to the valve body for controlling expansion of coolant flowing through the first fluid passage of the valve body;

a power element including a casing and a diaphragm coupled to the casing, the casing including a lower casing portion underlying the diaphragm and an upper casing portion overlying the diaphragm, the diaphragm having a first side operatively coupled to the valve member and a second side opposite the first side, wherein the second side of the diaphragm and the upper casing portion together form at least part of a sensing chamber that constitutes a thermal sensor of the expansion valve; and a ballast mounted in the sensing enclosure in spaced apart relation relative to the second side of the diaphragm;

wherein the expansion valve is devoid of a remote sensing bulb; and wherein the sensing chamber contains a thermal sensing fluid in fluid communication with the second side of the diaphragm, such that changes in the temperature of the sensing fluid results in changes in pressure applied to the second side of the diaphragm, thereby causing movement of the diaphragm which provides movement of the valve member operatively coupled to the first side of the diaphragm.

20. The bulbless thermal expansion valve according to claim 19, wherein:

a dome enclosure is mounted to the upper casing portion, the dome enclosure forming at least part of the sensing chamber, and the ballast is mounted to an inner surface of the dome enclosure.

* * * * *